US006360815B1

(12) United States Patent
Vadrot et al.

(10) Patent No.: US 6,360,815 B1
(45) Date of Patent: Mar. 26, 2002

(54) ARRANGEMENT FOR MOUNTING A FAN MOTOR ON A HEAT EXCHANGER AND AUTOMOBILE VEHICLE FRONT ASSEMBLY PROVIDED WITH THAT ARRANGEMENT

(75) Inventors: Alain Vadrot, Mandeure; Alain Battel, Audincourt; David Negre, Seloncourt, all of (FR)

(73) Assignee: Ecia Industrie, Boulogne Billancourt (FR)

( * ) Notice: Subject to any disclaimer, the term of this patent is extended or adjusted under 35 U.S.C. 154(b) by 0 days.

(21) Appl. No.: 09/669,905

(22) Filed: Sep. 27, 2000

(51) Int. Cl.[7] ..... F01P 5/02
(52) U.S. Cl. ..... 165/121; 123/41.49; 165/DIG. 304
(58) Field of Search ..... 165/67, 121; 123/41.49

(56) References Cited

U.S. PATENT DOCUMENTS 5,341,871 A * 8/1994 Stelzer ..... 165/121
5,348,079 A 9/1994 Tanaka
5,527,284 A * 6/1996 Ohnemus et al. ..... 604/110
5,638,894 A * 6/1997 Potier et al. ..... 165/121
6,032,727 A * 3/2000 Martins ..... 165/149
6,077,124 A * 6/2000 Etters et al. ..... 439/632

FOREIGN PATENT DOCUMENTS

FR 2730008 8/1996

* cited by examiner

*Primary Examiner*—Allen Flanigan

(57) ABSTRACT

In an arrangement for mounting a fan motor on a heat exchanger comprising a body extending between two heat-exchange fluid tanks connected together by tubes carrying cooling fins and in which a heat-exchange fluid flows, the motor is fixed to a support at least one portion of which is molded onto the body. The motor is preferably fixed to the support by at least one screw, for example a self-tapping screw, screwed into the support. The molded material is preferably a plastics material.

9 Claims, 1 Drawing Sheet

ARRANGEMENT FOR MOUNTING A FAN MOTOR ON A HEAT EXCHANGER AND AUTOMOBILE VEHICLE FRONT ASSEMBLY PROVIDED WITH THAT ARRANGEMENT

BACKGROUND OF THE INVENTION

1. Field of the Invention

The present invention relates to an improved arrangement for mounting a fan motor on a heat exchanger and an automobile vehicle front assembly provided therewith.

2. Description of the Prior Art

There is already known in the art an arrangement for mounting a fan motor on a heat exchanger comprising a body extending between two heat-exchange fluid tanks connected by tubes carrying cooling fins and in which a heat-exchange fluid flows.

An arrangement of the above type is described in FR-A-2 748 559, for example. In that document the fan a motor is fixed to the body of the exchanger by means of arms hooked onto the edges of the body, for example. It is found that the fixing arms tend to create unwanted airflow disruption and noise effects.

The object of the invention is to prevent such unwanted airflow disruption and noise effects and to minimize the weight and cost of the arrangement used to mount the fan motor on the heat exchanger.

SUMMARY OF THE INVENTION

The invention provides an arrangement for mounting a fan motor on a heat exchanger comprising a body extending between two heat-exchange fluid tanks connected together by tubes carrying cooling fins and in which a heat-exchange fluid flows, wherein the motor is fixed- to a support at least one portion of which is molded onto the body.

According to other features of the arrangement:

- the support comprises an elastomer first portion connected to the body and a plastics material second portion molded at the same time as the first portion and connected to the motor,
- the at least one portion of the support which is molded onto the body is made of a plastics material,
- the motor is fixed to the support by at least one screw screwed into the support,
- the at least one screw is a self-tapping screw,
- the motor includes at least one fixing lug forming an apertured seat for the screw, and
- the support is provided with at least one motor fixing finger and the screw is screwed into an axial hole in the finger.

The invention also provides an automobile vehicle front assembly comprising an arrangement as defined above.

The invention will be better understood after reading the following description, which is given by way of example only and with reference to the accompanying drawing.

DETAILED DESCRIPTION OF THE PREFERRED EMBODIMENT

Figure 1:
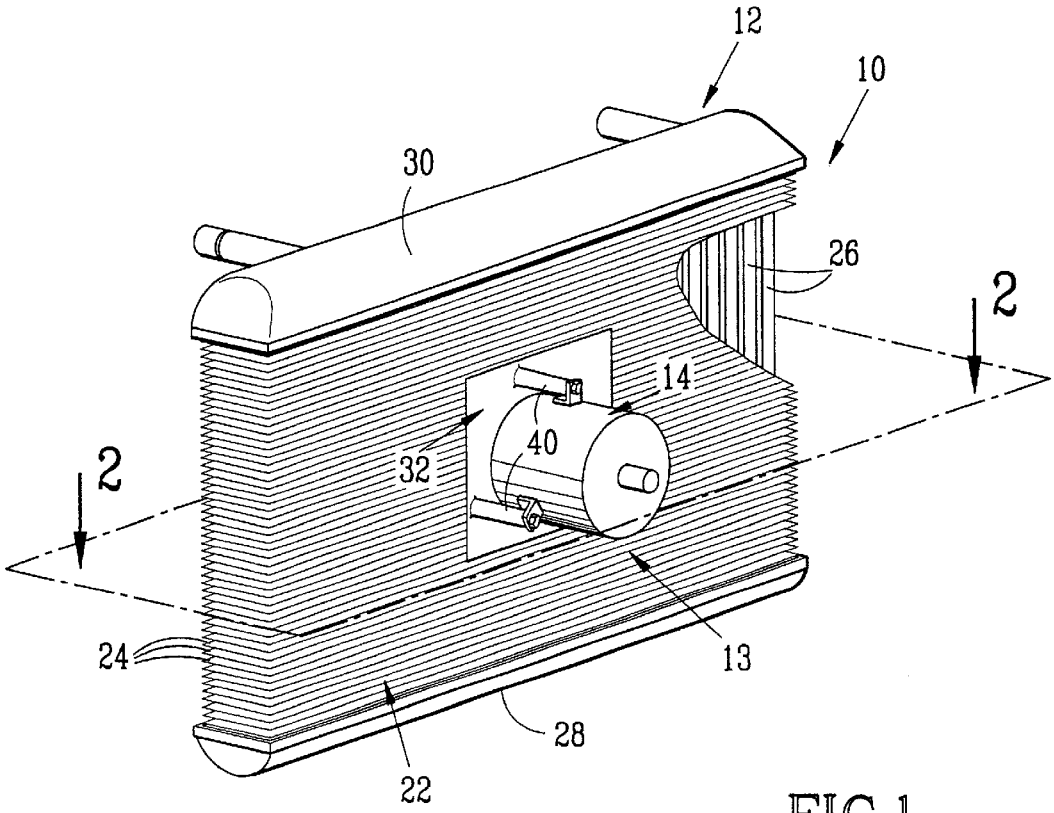
FIG. 1 is a perspective view of a heat exchanger on which a fan motor is mounted using an arrangement in accordance with the invention.
Figure 2:
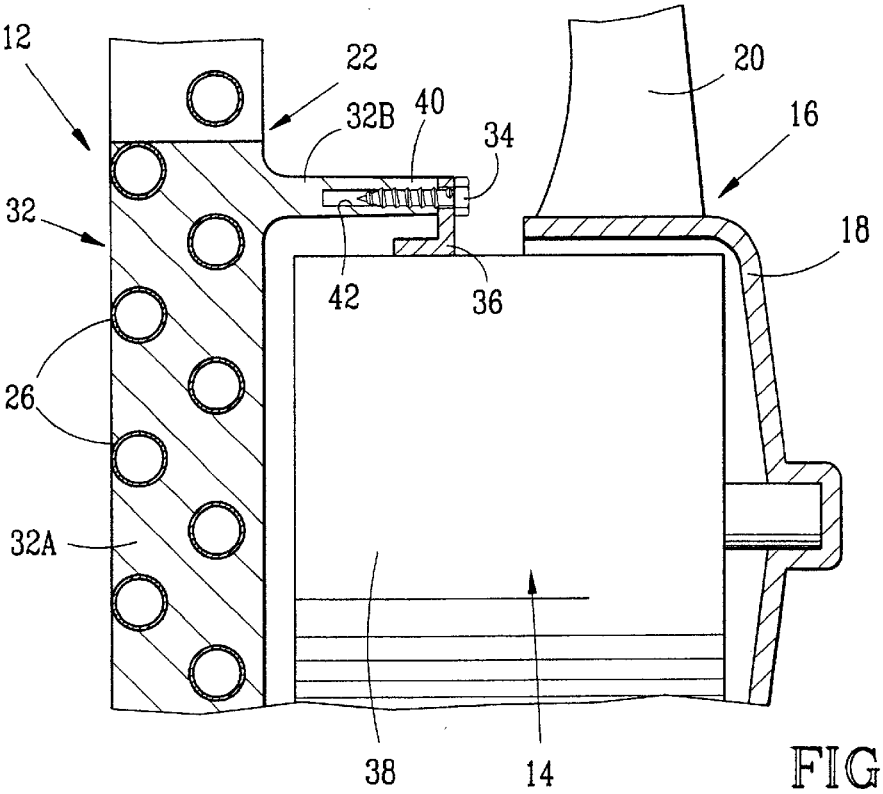
FIG. 2 is a view of the heat exchanger in section taken along the line 2—2 in FIG. 1, showing in more detail how the fan motor is fixed to the body of the heat exchanger.

FIG. 1 shows an automobile vehicle front assembly 10 provided with a heat exchanger 12 and an electric fan unit 13. The electric fan unit 13 includes an electric motor 14 driving a standard fan 16 provided with a cowl 18 and a series of blades 20, only one of which is shown in FIG. 2. The fan 16 is not shown in FIG. 1 for simplicity. It is mounted on the shaft of the motor 14 in a manner that is known in the art.

The heat exchanger includes a body 22 provided with cooling fins 24 carried by a bundle of tubes 26 in which a heat-exchange fluid flows.

The body 22 extends between two heat-exchange fluid tanks, a bottom tank 28 and a top tank 30. The tanks 28, 30 are connected together by substantially vertical tubes 26.

The fins 24 are plane, for example, and the tubes 26 pass through them.

The body 22 has a flattened and substantially parallelepipedal general shape defining parallel and substantially vertical opposite large faces. The motor 14 is fixed to one of these two large faces of the body 22, as described below.

The motor 14 is fixed to a support 32 having at least one portion molded onto the body 22. The material of the molded portion is preferably a thermosetting plastics material or thermoplastics material. The molding is performed by a method known in the art, for example by injecting or compressing the plastics material so that the fins 24 and the tubes 26 are at least partly embedded in the plastics material.

The support 32 preferably has an elastomer first part 32A connected to the body 22 and a plastics material second part 32B connected to the motor 14 and molded at the same time as the first part 32A.

The first part 32A of the support, which has a rubber-like elasticity, absorbs vibration of the motor 14 to prevent it propagating into the body 22 of the heat exchanger.

The motor 14 is fixed to the support 32 by at least one screw, preferably a self-tapping screw, screwed into the support 32. In the example described the motor 14 is fixed to the support 32 by three self-tapping screws 34.

The screws 34 are carried by three fixing lugs 36 each forming an apertured seat for the corresponding screw 34. The lugs 36 are attached to the outside of a generally cylindrical housing 38 of the motor 14.

The second part 32B of the support is provided with three fixing fingers 40 associated with the three screws 34. Each screw 34 is screwed into an axial blind hole 42 in a corresponding finger 40.

Note that, unlike the first part 32A, the second part 325 of the support has no rubber-like elasticity and provides a rigid connection between the support 32 and the screws 34.

The invention is not limited to the embodiment previously described. In particular, the molded material is not necessarily a plastics material and could instead be aluminum or an aluminum alloy.

The advantages of the invention include the fact that it enables the fan motor to be fixed to the body of the heat exchanger with simple, light and low-cost fixing means, which fixing means minimize unwanted airflow disruption and noise effects.

There is claimed:

1. An arrangement for mounting a fan motor on a heat exchanger comprising a body extending between two heat-exchange fluid tanks connected together by tubes carrying cooling fins and in which a heat-exchange fluid flows, wherein said motor is fixed to a support at least one portion of which is molded onto an internal region of said body, said internal region being spaced apart from a periphery of said body and including sections of several of said tubes and several of said fins, said sections defining spaces therebetween which are substantially fully filled by said at least one portion.

2. The arrangement claimed in claim 1 wherein said support comprises an elastomer first portion connected to said body and a plastics material second portion molded at the same time as said first portion and connected to said motor.

3. The arrangement claimed in claim 1 wherein said at least one portion of said support which is molded onto said body is made of a plastics material.

4. The arrangement claimed in claim 1 wherein said motor is fixed to said support by at least one screw screwed into said support.

5. The arrangement claimed in claim 4 wherein said at least one screw is a self-tapping screw.

6. The arrangement claimed in claim 4 wherein said motor includes at least one fixing lug forming an apertured seat for said screw.

7. The arrangement claimed in claim 4 wherein said support is provided with at least one motor fixing finger and said screw is screwed into an axial hole in said finger.

8. An automobile vehicle front assembly comprising an arrangement in accordance with any claim 1.

9. The arrangement claimed in claim 1 wherein said internal region comprises sections of at least three fins.

* * * * *